US008395441B1

(12) United States Patent
Thinakaran

(10) Patent No.: US 8,395,441 B1
(45) Date of Patent: Mar. 12, 2013

(54) DYNAMIC BIASING CIRCUIT

(75) Inventor: Rajavelu Thinakaran, Karnkataka (IN)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 13/278,414

(22) Filed: Oct. 21, 2011

(51) Int. Cl.
*G05F 1/10* (2006.01)
*G05F 3/02* (2006.01)

(52) U.S. Cl. ..... 327/541; 327/543

(58) Field of Classification Search ..... 327/530, 327/538, 540, 541, 543
See application file for complete search history.

(56) References Cited

U.S. PATENT DOCUMENTS 4,409,497 A * 10/1983 Nagano ..... 327/70
5,963,062 A * 10/1999 Fujii ..... 327/74
6,803,809 B2 * 10/2004 Saitoh ..... 327/541

* cited by examiner

*Primary Examiner* — Quan Tra
(74) *Attorney, Agent, or Firm* — John R. Pessetto; W. James Brady; Frederick J. Telecky, Jr.

(57) ABSTRACT

A dynamic biasing circuit includes a first input pair coupled to a second input pair, the first input pair including a first transistor and a second transistor with sources coupled to each other, and the second input pair comprising a third transistor and a fourth transistor with sources coupled to each other, the sources receiving a bias current. A first current mirror that generates an output current is coupled to the first input pair. A second current mirror is coupled to the first input pair and the second input pair. The second current mirror is configured to force the current to drop in the fourth transistor in response to sensing a current drop in the first transistor such that the bias current flows through the second and third transistors that boosts the output current.

18 Claims, 2 Drawing Sheets

DYNAMIC BIASING CIRCUIT

TECHNICAL FIELD

Embodiments of the disclosure relate generally to dynamic biasing circuits.

BACKGROUND

With the proliferation of battery operated devices, low power operation has become an important criterion in integrated circuit (IC) design. There are several applications where the circuit operates in standby mode for most of the time during operation. The quiescent current for such circuits has to be reduced as much as possible to reduce power consumption. However, reducing quiescent current impacts the transient or dynamic performance of the circuit such as slew rate and settling time. For example, the quiescent current of a reference buffer in a successive approximation analog to digital converter (SAR ADC) with capacitive DAC can be reduced as much as possible so as to just meet the noise and bandwidth specification. However, doing so severely compromises the settling time of the reference buffer as the reference buffer typically needs much higher slew current to charge the DAC capacitance when there is a DAC code change. Increasing the quiescent current to meet the slew requirement will be highly inefficient especially if the circuit is in quiescent state for most of the time.

Dynamic biasing circuits are used to achieve low quiescent power without sacrificing the transient performance. Dynamic biasing circuit works by boosting the current only when required. In the above reference buffer example, when there is a DAC code change, the reference buffer output voltage will reduce. This reduction in output voltage can be sensed by comparing it with the input reference voltage and boosting the bias current of the buffer to meet the slew current requirement.

Figure of merit (FOM) for such a dynamic biasing circuit is the ratio of the quiescent current to the boosted current. Higher FOM means the circuit can achieve higher speed or slew rate for the same quiescent current. Also for a given speed or slew requirement, higher FOM means the quiescent current can be reduced so as to achieve lower power operation.

SUMMARY

This Summary is provided to comply with 37 C.F.R. §1.73, requiring a summary of the invention briefly indicating the nature and substance of the invention. It is submitted with the understanding that it will not be used to interpret or limit the scope or meaning of the claims.

An embodiment discloses a dynamic biasing circuit. The biasing circuit includes a first input pair coupled to a second input pair, the first input pair including a first transistor and a second transistor with sources coupled to each other, and the second input pair comprising a third transistor and a fourth transistor with sources coupled to each other, the sources receiving a bias current. A first current mirror, generates an output current, and is coupled to the first input pair and the second input pair. A second current mirror is coupled to the first input pair and the second input pair. The second current mirror is configured to force the current to drop in the fourth transistor in response to sensing a current drop in the first transistor such that the bias current flows through the second and third transistors that boosts the output current. In another embodiment a reference buffer is coupled to the biasing circuit having the first current mirror and the second current mirror.

Other aspects and example embodiments are provided in the drawings and the detailed description that follows.

BRIEF DESCRIPTION OF THE VIEWS OF DRAWINGS

DETAILED DESCRIPTION OF THE EMBODIMENTS

Figure 1:
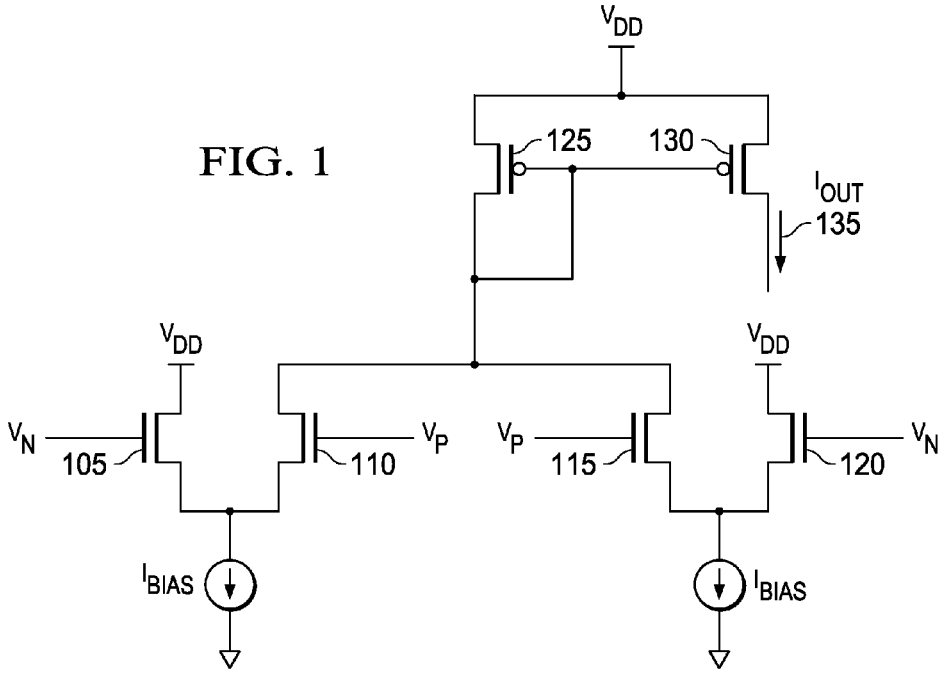
FIG. 1 illustrates a biasing circuit.

FIG. 1 illustrates a dynamic biasing circuit. The biasing circuit includes a first input pair having transistors 105 (first transistor) and 110 (second transistor). The first input pair is coupled to a second input pair having transistors 115 (third transistor) and 120 (fourth transistor). Sources of the transistors 105 and 110 are connected to each other and the sources receive a bias current ($I_{bias}$). Similarly sources of 115 and 120 are connected to each other and the sources receive a bias current ($I_{bias}$). Gate of the transistors 105 receive a negative voltage and gate of the transistor 110 receives a positive voltage. Similarly gates of the transistors 120 receive a negative voltage and gate of the transistor 115 receives a positive voltage. Drains of transistors 105 and 120 receive a supply voltage $V_{DD}$. Drains of the transistors 110 and 115 are coupled to each other. A current mirror comprising of diode 125 and transistor 130 is connected to the drains of the transistors 110 and 115. Source of the diode 125 and 130 receive a supply voltage. Gates of 125 and 130 are connected to each other. An output of the biasing circuit is taken out on the drain of transistor 130 on a line 135.

In FIG. 1, under quiescent condition, input voltages $V_N$ and $V_P$ will be equal. The bias current, $I_{bias}$ connected to sources of transistors 105 and 110 distributes between transistors 105 and 110 in proportion to the width of 105 and 110. Similarly $I_{bias}$ connected to sources of transistors 115 and 120 distributes between transistors 115 and 120 in proportion to the width of transistors 115 and 120. Sum of current in transistors 110 and 115 flows through transistor 125 and is mirrored into transistor 130. If N is the ratio of width of transistors 105 and 110 and ratio of width of transistors 120 and 115, then output current through transistor 130 is $I_{bias}*2/(N+1)$. Under slew conditions, when $V_N<V_P$, then current in transistors 105 and 115 drops to zero and current in transistors 110 and 120 increases to $I_{bias}$. Thus the current in transistor 125 increase to $I_{bias}$ which in turn mirrors the current into the transistor 130. Thus under slew condition, the output current of this circuit is $I_{bias}$. The figure of merit (FOM) for this circuit is the ratio of slew current to quiescent current and is equal to (N+1)/2. This ratio is an important figure of merit for the dynamic bias circuit because of the following reasons. In a scenario where the quiescent current will have to be chosen to meet certain criteria (for example noise), the ratio determines the maximum speed or drive capability that can be achieved. In a scenario where the slew current will have to be chosen to meet certain criteria (for example slew rate), the ratio determines the lowest quiescent power that can be achieved. Though theoretically it is possible to achieve very high ratio just by increasing N, in practice, it is not possible to increase N beyond an extent for the following reasons. Transistors 105,

110,115,120 need to be biased in inversion or weak inversion region because once they enter sub-threshold, the mirroring ratio becomes sensitive to voltage mismatch. As keep increasing N, the parasitic in the source node of a transistor keeps increasing as this slows down the circuit.

Figure 2:
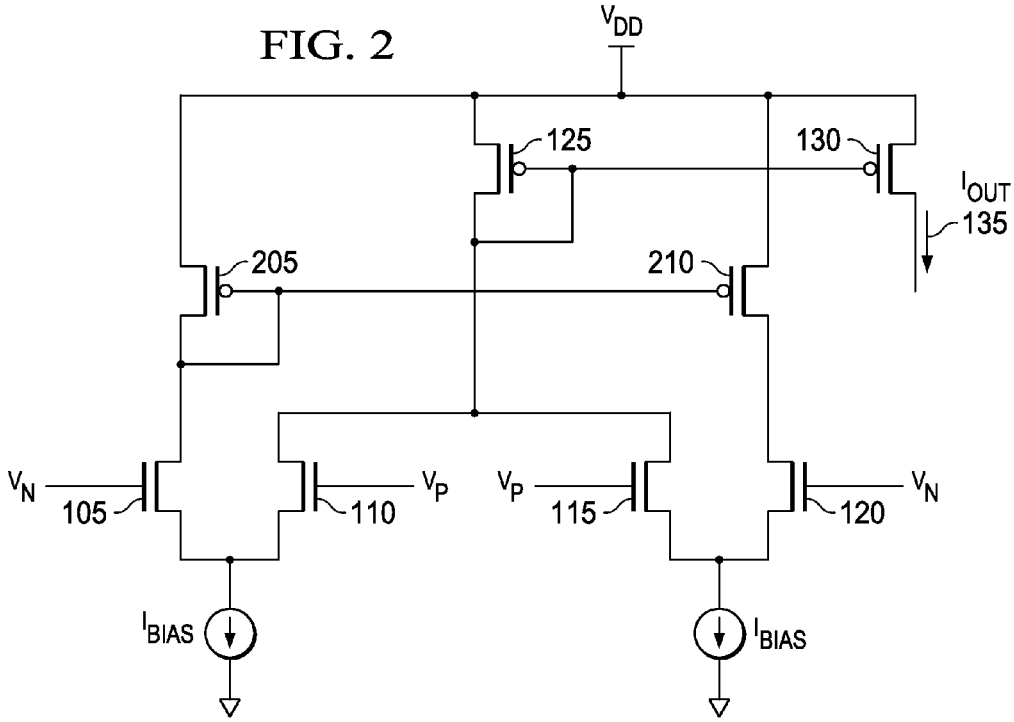
FIG. 2 illustrates a dynamic biasing circuit according to an embodiment.

FIG. 2 illustrates a dynamic biasing circuit according to an embodiment. The biasing circuit includes a first input pair having transistors 105 (first transistor) and 110 (second transistor). The first input pair is coupled to a second input pair having transistors 115 (third transistor) and 120 (fourth transistor). Sources of the transistors 105 and 110 are connected to each other and the sources receive a bias current ($I_{bias}$). Sources of the transistors 115 and 120 are connected to each other and the sources receive a bias current ($I_{bias}$). Gate of the transistors 105 receive a negative voltage ($V_N$) and gate of the transistor 110 receives a positive voltage ($V_P$). Similarly gates of the transistor 120 receive a negative voltage and gate of the transistor 115 receives a positive voltage. Drains of the transistors 110 and 115 are coupled to each other. A current mirror comprising of diode 125 and transistor 130 (together forming a first current mirror) is connected to the drains of the transistors 110 and 115 (in other words connected to the first input pair and the second input pair). Source of the diode 125 and transistor 130 receive a supply voltage. Gates of transistors 125 and 130 are connected to each other. An output of the dynamic biasing circuit is taken out on the drain of transistor 130 (sixth transistor) on a line 135. Transistors 205 (second diode) and 210 (fifth transistor) form a current mirror (second current mirror). Gates of transistors 205 and 210 are connected together. Sources of transistors 205 and 210 receive a supply voltage. Drain of transistor 210 is coupled to drain of transistor 120. Gate and drain of transistor 205 are coupled together. Drain of transistor 105 is coupled to drain of 205.

In FIG. 2, under quiescent condition, input voltages $V_N$ and $V_P$ will be equal. The bias current $I_{bias}$ connected to sources of transistors 105 and 110 distributes between transistors 105 and 110 in proportion to the width of transistors 105 and 110. Similarly $I_{bias}$ connected to sources of transistors 115 and 120 distributes between transistors 115 and 120 in proportion to the width of transistors 115 and 120. Sum of current in transistors 110 and 115 flows through transistor 125 and is mirrored into transistor 130. If N is the ratio of width of transistors 105 and 110 and ratio of width of transistors 120 and 115, then output current through transistor 130 is $I_{bias}*2/(N+1)$.

In FIG. 2, under slew conditions, when $V_N < V_P$, a second current mirror (formed by transistors 205 and 210) coupled to the transistors 105 and 110 (first input pair) and transistors 115 and 120 (the second input pair), forces the current to drop in the transistor 120 in response to sensing a current drop in the transistor 105 such that the bias current flows through the transistors 110 and 115 that boosts the output current in the biasing circuit. This is explained in detail now. Under slew conditions, current in transistor 105 drops to zero and current in transistor 110 increases to $I_{bias}$. The current in transistor 115 initially drops to zero and the current in transistor 120 initially increases to $I_{bias}$. Transistor 205 senses the current drop in transistor 105 and mirrors it to transistor 210. Thus momentarily the current in transistor 210 is zero and current in transistor 120 is $I_{bias}$. This will cause the drain and source voltage of transistor 120 to decrease. When the source voltage of transistor 120 drops sufficiently, then the current $I_{bias}$ will start flowing through transistor 115 and current in transistor 120 decreases to zero. The current in transistors 110 and 115 add and a current of $2*I_{bias}$ flows into transistor 125 which in turn mirrors the current into output transistor 130. Thus under slew condition, the output current of this circuit is $2*I_{bias}$. The FOM for this circuit is the ratio of slew current to quiescent current and is equal to (N+1) which is twice that of circuit in FIG. 1. In other words, using transistors 205 and 210 the output current of the biasing circuit is boosted by a factor of two. The dynamic biasing circuit of FIG. 2 increases the output current twice (and hence speed) with no power penalty for applications where performance is critical or reduction in quiescent current by a factor of two and hence power for same slew current. The area penalty with the dynamic biasing circuit is negligible as only two additional transistors are required compared to the biasing circuit of FIG. 1.

Figure 3:
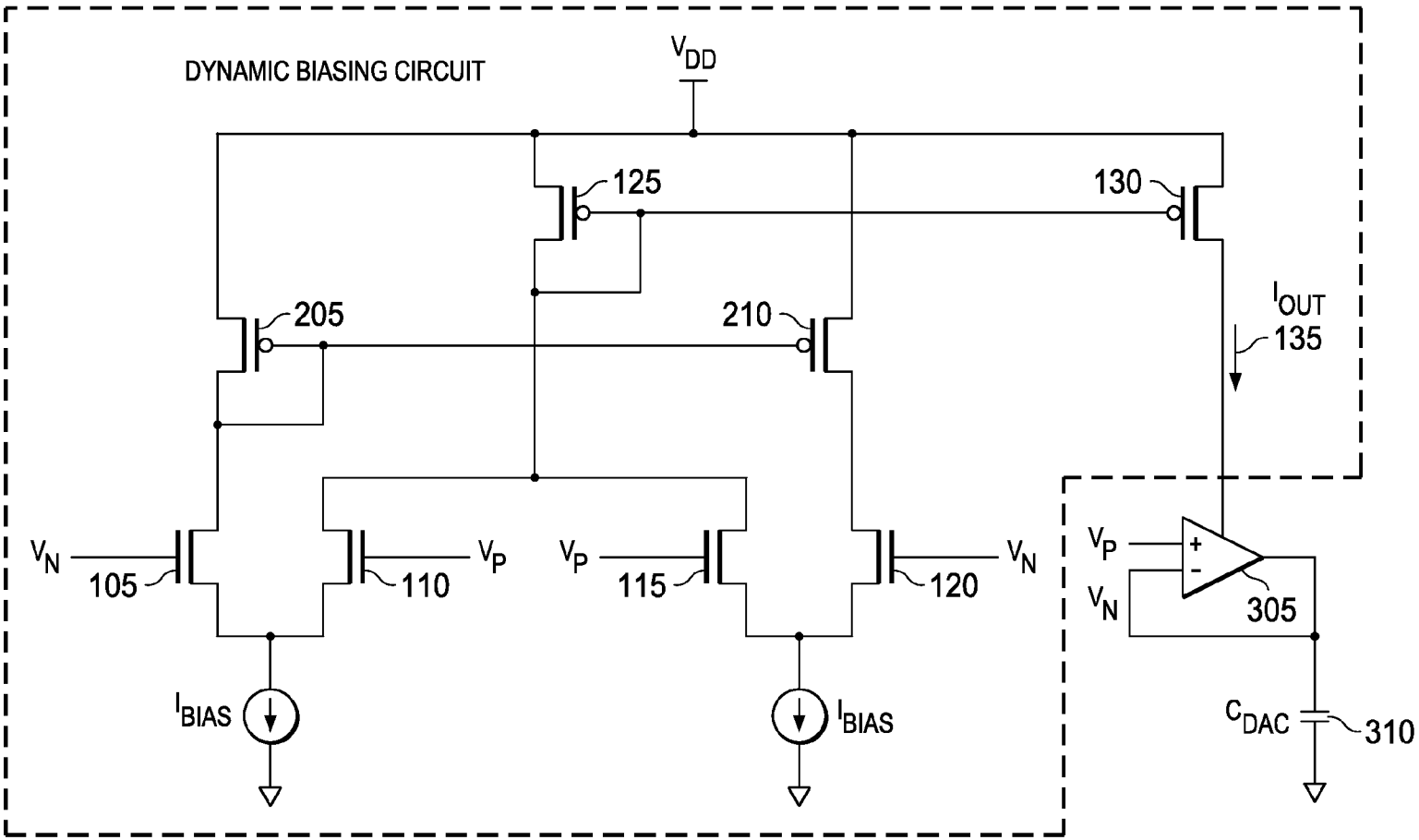
FIG. 3 illustrates a reference buffer connected to a dynamic biasing circuit according to an embodiment.

FIG. 3 illustrates a reference buffer 305 connected to a dynamic biasing circuit according to an embodiment. An operational amplifier used a reference buffer 305 and capacitor 310 is the capacitive load connected to the output of 305. The positive input of the operational amplifier is connected to the gates of transistors 110 and 120 and negative input (i.e. output) of the operational amplifier is connected to gates of transistors 105 and 115. The bias current input of the reference buffer 305 is connected to drain of 130 which is the output of the dynamic biasing circuit. The dynamic biasing circuit is analogous to the dynamic biasing circuit of FIG. 2 in connections and operation. The dynamic biasing circuit boosts the output current by a factor of two which is supplied as a bias current input to reference buffer 305. Using this embodiment increases the output current of the dynamic biasing circuit twice (and hence speed) with no power penalty for applications where performance is critical (for example in reference buffers used in an ADC) or reduction in quiescent current by a factor of two and hence power for same slew current. In one embodiment, transistors 105, 110, 115 and 120 are implemented as NMOS transistors and transistors 125, 130, 205 and 210 are implemented as PMOS transistors. In another embodiment, transistors 105, 110, 115 and 120 are implemented as PMOS transistors and transistors 125, 130, 205 and 210 are implemented as NMOS transistors.

In the foregoing discussion, the terms "connected" means at least either a direct electrical connection between the devices connected or an indirect connection through one or more passive intermediary devices. The term "circuit" means at least either a single component or a multiplicity of passive components, that are connected together to provide a desired function. The term "signal" means at least one current, voltage, charge, data, or other signal.

The forgoing description sets forth numerous specific details to convey a thorough understanding of the invention. However, it will be apparent to one skilled in the art that the invention may be practiced without these specific details. Well-known features are sometimes not described in detail in order to avoid obscuring the invention. Other variations and embodiments are possible in light of above teachings, and it is thus intended that the scope of invention not be limited by this Detailed Description, but only by the following Claims.

What is claimed is:

1. A biasing circuit comprising:

a first input pair coupled to a second input pair, the first input pair comprising a first transistor and a second transistor with sources coupled to each other, and the second input pair comprising a third transistor and a fourth transistor with sources coupled to each other, the sources receiving a bias current;

a first current mirror, that generates an output current, the first current mirror being coupled to the first input pair and the second input pair; and a second current mirror coupled to the first input pair and the second input pair, the second current mirror being configured to force the current to drop in the fourth transistor in response to sensing a current drop in the first transistor such that the bias current flows through the second and third transistors that boosts the output current.

2. The biasing circuit of claim 1, wherein the second current mirror comprises a first diode and a fifth transistor with gates coupled to each other, and wherein the first diode is coupled to a drain of the first transistor that senses a current drop in the first transistor.

3. The biasing circuit of claim 2, wherein drains of the fifth transistor and the fourth transistor are coupled to each other and the fifth transistor is configured to force the current to drop in the fourth transistor in response to sensing a current drop in the first transistor.

4. The biasing circuit of claim 1, wherein drains of the second transistor and the third transistor are coupled to each other and further coupled to a second diode of the first current mirror.

5. The biasing circuit of claim 1, wherein the first current mirror comprises a sixth transistor coupled to the second diode and the output current is generated from the sixth transistor.

6. The biasing circuit of claim 1, wherein gates of the first transistor and third transistor receive a first input voltage and the gates of the second and fourth transistor receive a second input voltage.

7. The biasing circuit of claim 6, wherein the first input voltage is a negative input voltage and the second input voltage is a positive input voltage.

8. The biasing circuit of claim 7, wherein the current drop in the first transistor is due to the drop in negative input voltage.

9. The biasing circuit of claim 1 boosts the output current by a factor of two.

10. The biasing circuit of claim 1, wherein the output current is a ratio of slew current to quiescent current in the biasing circuit.

11. A circuit comprising:

a reference buffer coupled to a biasing circuit; and the biasing circuit comprising:

a first input pair coupled to a second input pair, the first input pair comprising a first transistor and a second transistor with sources coupled to each other, and the second input pair comprising a third transistor and a fourth transistor with sources coupled to each other, the sources receiving a bias current;

a first current mirror, that generates an output current, the first current mirror being coupled to the first input pair and the second input pair; and a second current mirror coupled to the first input pair and the second input pair, the second current mirror being configured to force the current to drop in the fourth transistor in response to sensing a current drop in the first transistor such that the bias current flows through the second and third transistors that boosts the output current by a factor of two.

12. The circuit of claim 11, wherein the biasing circuit comprises a second current mirror including a first diode and a fifth transistor with gates coupled to each other, and wherein the first diode is coupled to a drain of the first transistor that senses a current drop in the first transistor.

13. The circuit of claim 11, wherein drains of the fifth transistor and the fourth transistor are coupled to each other and the fifth transistor is configured to force the current to drop in the fourth transistor in response to sensing a current drop in the first transistor.

14. The biasing circuit of claim 11, wherein gates of the first transistor and third transistor receive a negative input voltage and the gates of the second and fourth transistor receive a positive input voltage, and wherein the current drop in the first transistor is due to the drop in negative input voltage.

15. The biasing circuit of claim 11, wherein the reference buffer comprises an operational amplifier having a capacitive load coupled to an output of the reference buffer.

16. A dynamic biasing circuit comprising:

a first input pair coupled to a second input pair, the first input pair comprising a first transistor and a second transistor with sources coupled to each other, and the second input pair comprising a third transistor and a fourth transistor with sources coupled to each other, the sources receiving a bias current;

a first current mirror, that generates an output current, the first current mirror being coupled to the first input pair and the second input pair; and a second current mirror coupled to the first input pair and the second input pair, the second current mirror being configured to force the current to drop in the fourth transistor in response to sensing a current drop in the first transistor such that the bias current flows through the second and third transistors that boosts the output current, the second current mirror including a first diode and a fifth transistor with gates coupled to each other, and wherein the first diode is coupled to a drain of the first transistor that senses a current drop in the first transistor due to a drop in an input voltage to the first transistor, and wherein drains of the fifth transistor and the fourth transistor are coupled to each other and the fifth transistor is configured to force the current to drop in the fourth transistor in response to sensing a current drop in the first transistor.

17. The biasing circuit of claim 16, wherein gates of the first transistor and third transistor receive a negative input voltage and the gates of the second and fourth transistor receive a positive input voltage, and wherein the current drop in the first transistor is due to the drop in negative input voltage.

18. The biasing circuit of claim 16, wherein the second current mirror being configured to force the current to drop in the fourth transistor under slew conditions where negative input voltage is lesser than the positive input voltage.

* * * * *